United States Patent [19]

Kadotani et al.

[11] Patent Number: 4,823,581

[45] Date of Patent: Apr. 25, 1989

[54] BEARING WHEEL BODY FORMING APPARATUS

[76] Inventors: Kazuo Kadotani; Hideo Kadotani, both of 28-45, Tojocho, Kokubu, Kashiwara, Japan

[21] Appl. No.: 91,348

[22] Filed: Aug. 27, 1987

Related U.S. Application Data

[63] Continuation of Ser. No. 844,616, Mar. 27, 1986, abandoned.

[51] Int. Cl.[4] ..... B21D 15/04

[52] U.S. Cl. ..... 72/105

[58] Field of Search ..... 72/105, 108; 29/159 R

[56] References Cited

U.S. PATENT DOCUMENTS

| | | | |
|---|---|---|---|
| 3,599,463 | 8/1971 | Sennstrom | 72/108 |
| 3,803,890 | 4/1974 | Connell | 72/108 |
| 4,064,724 | 12/1977 | Armstrong | 72/108 |

*Primary Examiner*—P. W. Echols

*Attorney, Agent, or Firm*—Moonray Kojima

[57] ABSTRACT

A bearing wheel body forming apparatus comprising a wheel body forming roller, a mandrel and a support roller all supported rotatably in parallel with pressing force also applied to the forming roller and support roller, wherein the forming roller and support roller are driven via a one way clutch and a free coupling. When the circumferential speed of the outer circumference of the wheel body being formed is greater than the circumferential speed of the driven surface of the mandrel, the forming roller is set free by the free coupling so that at the forming surface of the forming roller the speed will be the same as the outer circumferential speed of the work body. In this manner, substantially the same speed of working is used for the entire wheel body and thus prevents uneven forming, and thus prevents vibrations caused by uneven forming.

4 Claims, 15 Drawing Sheets

BEARING WHEEL BODY FORMING APPARATUS

This application is a continuation of Ser. No. 06/844,616 filed Mar. 27, 1986 now abandoned.

BACKGROUND OF THE INVENTION

1. Field of Invention

This invention relates to a bearing wheel body forming apparatus and particularly, to such an apparatus wherein the forming speed is controlled so as to result in more accurate concentric diameters of the wheel body.

2. Description of Prior Art

In forming a bearing wheel body comprising an inner circumferential surface, an outer circumferential surface and a body portion, a mandrel located next to a rotatable support roller is inserted into the wheel body while a wheel body forming roller is rotatably applied under pressure against the mandrel and the support roller so that the wheel body is rollingly formed into a desired shape for the inner circumferential surface, the outer circumferential surface and the body portion.

However, with the conventional wheel body forming apparatus, the wheel body has its width gradually thinned due to frictional wear during the rolling operation from initial rolling to final rolling. This results in such disadvantage as the wheel body having its circumferential moving speed changed gradually to a slow down state.

Also, if the speeds of forming roller and support roller are fixed, for example, being equal to each other, then circumferential speed of the wheel body is changed and becomes different from the circumferential speed of the forming roller. The result is that there occurs a "slip phenomenon" between the wheel body and the forming roller in order to offset the speed differential between the two. The "slip phenomenon" causes rotational irregularities to the wheel body which causes vibrations. Long term vibrations will cause the width of the wheel body to become thinned. In addition, the body may not be formed with a true circle which is a serious manufacturing defect.

Furthermore, the frictional wear of the wheel body forming roller is excessively increased due to the "slip phenomenon". This results in the disadvantage that the rollers must be replaced after only a short period of use, thus, reducing productivity and increasing costs.

SUMMARY OF THE INVENTION

Accordingly, the invention aims to eliminate all of the above and other disadadvantages and deficiencies of the prior art.

An object of the invention is to provide an improved bearing wheel body forming apparatus comprising a wheel forming roller, a mandrel, and a support roller wherein the rollers are adapted to be rollingly pressed against the wheel body which is inserted onto the mandrel to thereby rollingly press the wheel body into a desired shape. Advantageously, the wheel body can be formed with a small degree of pressing force applied to the circumferential surfaces of the wheel body.

Another object is to provide a bearing wheel body forming apparatus having a dimensionally small hydraulic mechanism.

A further object is to provide a bearing wheel body forming apparatus, wherein the roller permits its circumferential speed to change depending on the change of circumferential speed of the wheel body being rollingly press formed, which circumferential speed of the roller otherwise might cause change in the width and eccentricity of the wheel body so that the produced wheel bodies are always superior in quality.

A still further object is to provide a bearing wheel body forming apparatus according to which a variety of wheel bodies comprising an inner circumferential surface, an outer circumferential surface and a body portion, are produced by the same apparatus, and which result in reducing production costs.

DETAILED DESCRIPTION OF PREFERRED EMBODIMENTS.

Figure 1:
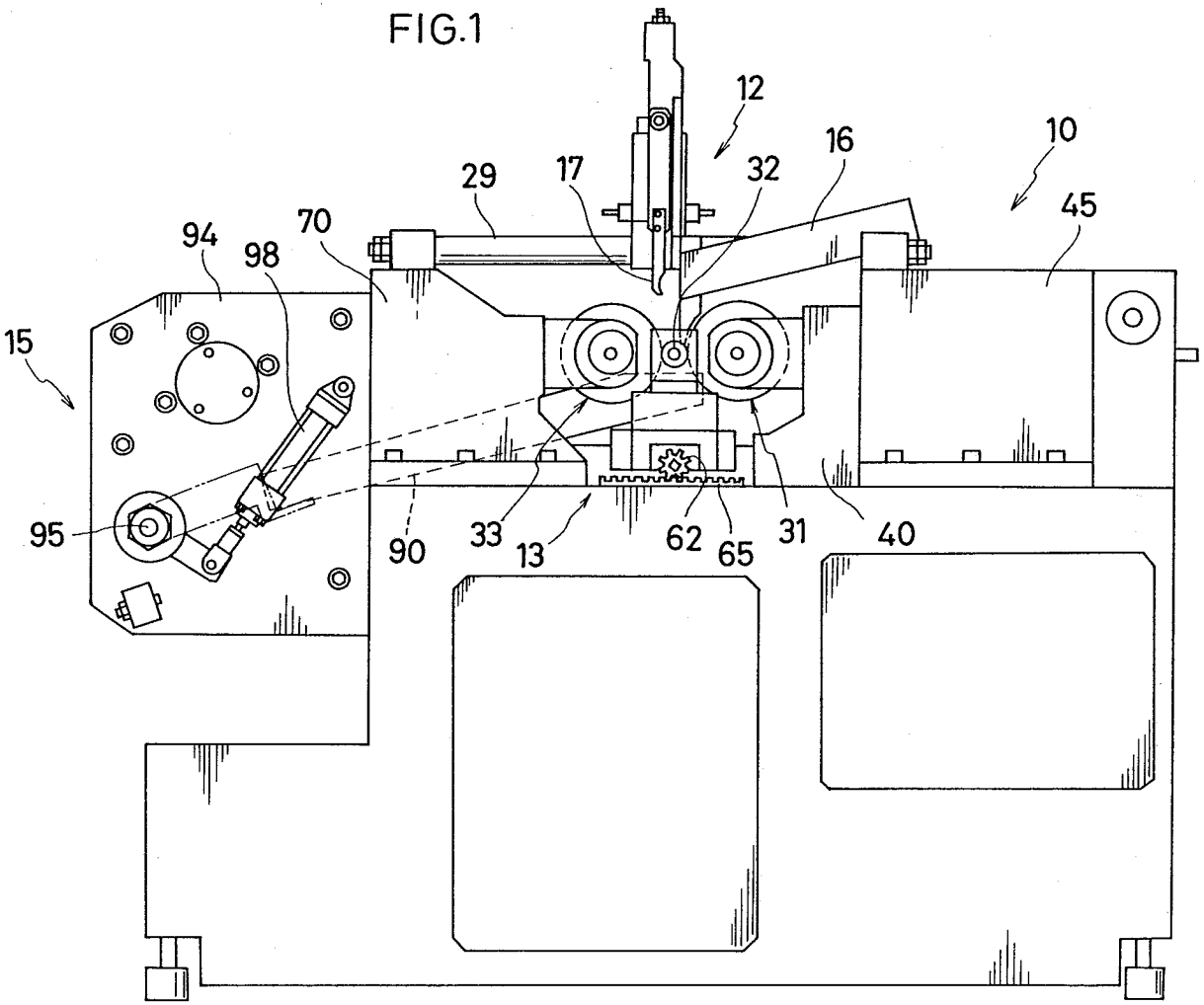
FIG. 1 is a front elevational view showing a bearing wheel body forming apparatus according to the invention.
Figure 2:
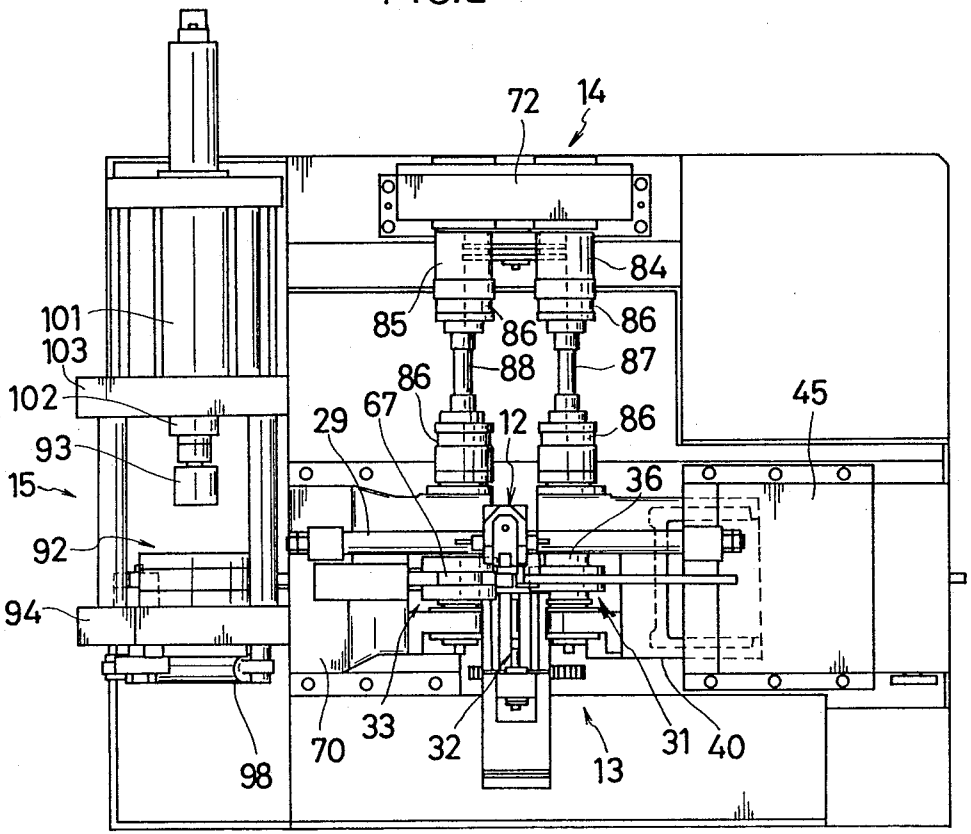
FIG. 2 is a top plan view thereof.
Figure 3:
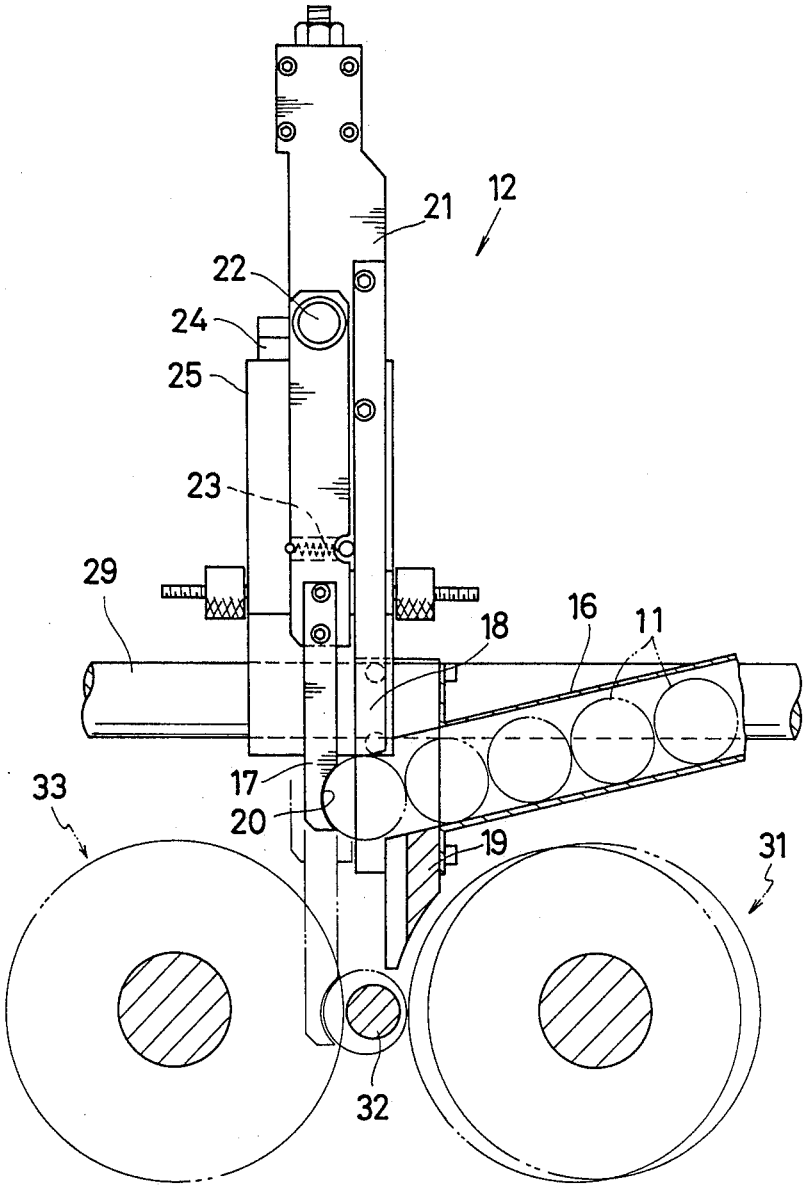
FIG. 3 is a front elevational view partially showing a feeding member of the invention.

The apparatus of the invention takes a cylindrical blank and then forms a rough formed wheel body having the formed inner circumferential surface, outer circumferential surface and body portion, and then finishes the rough formed wheel body to desired dimension inner and outer circumference surfaces and body portion. In FIGS. 1,2 and 3, a wheel body forming apparatus 10 comprises a wheel body 11, a feeder or feeding member 12 for feeding wheel body 11 to a forming member 13 which is adapted to form a fed wheel body 11 into a desired shape of an inner circumferential portion or surface, an outer circumferential portion or surface, and a body portion. The forming member 13 is adapted to form body 11 and is driven by a driving member 14 and is provided with a finishing member 15 for finishing a rough formed body 11 into a desired size body.

Description of Feeding Member

Figure 4:
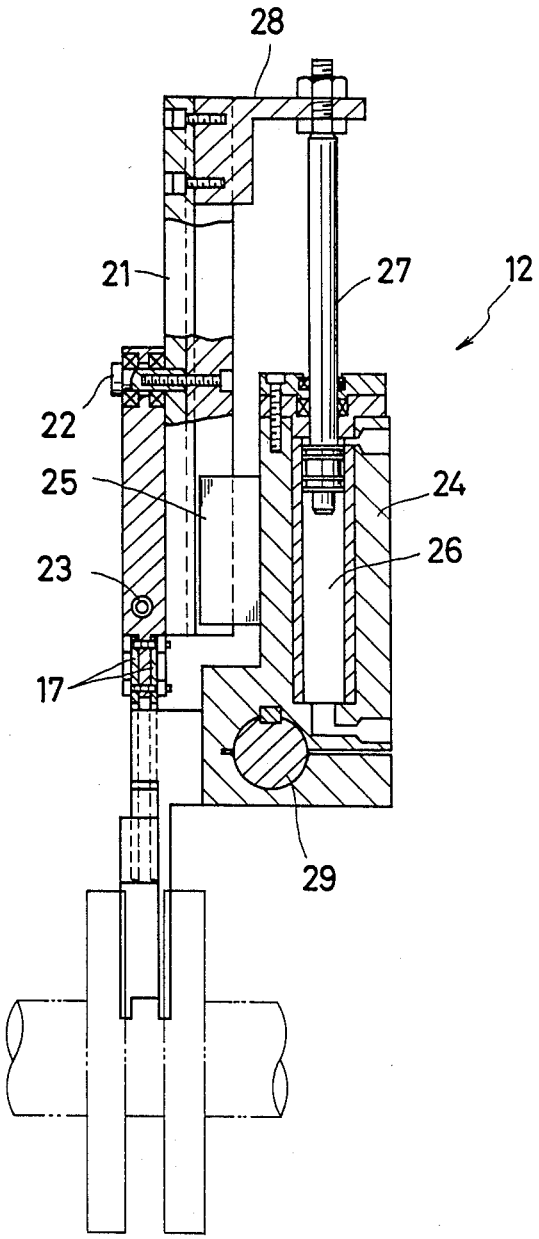
FIG. 4 is a side elevational view partially showing a wheel body forming member.

In FIGS. 3 and 4, feeding member 12 has a first chute 16 provided at an angle so that a row of wheel body blanks 11 is permitted to flow through first chute 16, a holder 17 adapted to pick up each wheel body 11 from first chute 16 and then feed the body 11 to a forming member disposed below first chute 16 and a pushing rod 18. First chute 16 comprises an elongated tube having a rectangular cross section and is disposed at an angle, as depicted, with both the upper end and the lower end thereof being opened so that wheel body 11 received from the upper open end will move down toward the lower open end by force of gravity. To the lower wall of the lower open end there is communicated a U shaped cross-sectional vertical guide member 19 extended toward lower forming member 13. The holder 17 has an arc shaped holding surface 20 for supporting wheel body 11 that runs down to a surface opposite to the front lower surface of chute 16. The pushing rod 18 is disposed so as to abut against the top surface of wheel body 11 that is supported on holding surface 20.

Pushing rod 18 has its upper portion rigidly fixed to the front surface area of a slider 21 while holder 17 is supported through its uppermost end to slider 21 , and at the same time supplied with a pressing force that resists against pushing rod 18 by means of a coil spring 23. Consequently, pushing rod 18 is made to move rearwardly (i.e. to the right in FIG. 3) against the compressed force of coil spring 23. As a result, the rightward movement of pushing rod 18 serves effectively to urge wheel body 11 to forcibly separate from forming member 13 once the wheel body 11 is fed to member 13.

Slider 21 is held in vertically slidable relation by guide 25 intercommunicated to the lower portion of a supporting frame member 24 mounted in vertical relation to slider 21. Holder 17 and pushing ruod 18 are supported in vertically reciprocal relation within the range between the lowermost opening and the center of forming member 13 disposed below the chute opening. Both slider 21 and guide 25 are held in position by a dovetail construction formed in accordance with well known methods. As shown in FIGS. 3 and 4, number 22 is a fastener holding slider 21 to an unnumbered part.

Inside of supporting frame member 24 there is formed a feeding cylinder 26 wherein both the uppermost end of an upwardly projecting piston 27 and slider 21 are connected to one another by a connecting member 28 so that slider 21 is made to vertically move by operation of feeding cylinder 26. The supporting frame member 24 has its lower portion rigidly fixed to a fixture rod 29. The feeder 12 removes a single wheel body 11 from chute 16 by the vertical motion of holder 17 and pushing rod 18 which are both driven by the driving motion of feeding cylinder 26.

Description of the Forming member

Figure 5:
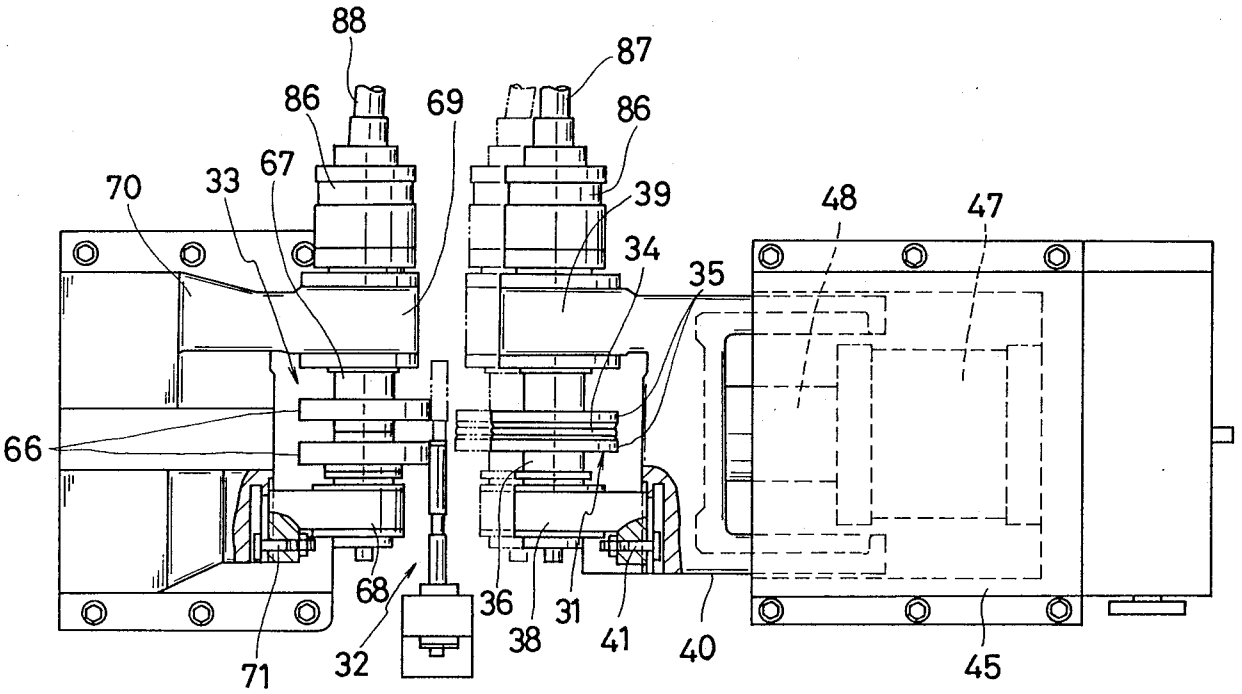
FIG. 5 is a top plan view partially showing the wheel body forming member.
Figure 6:
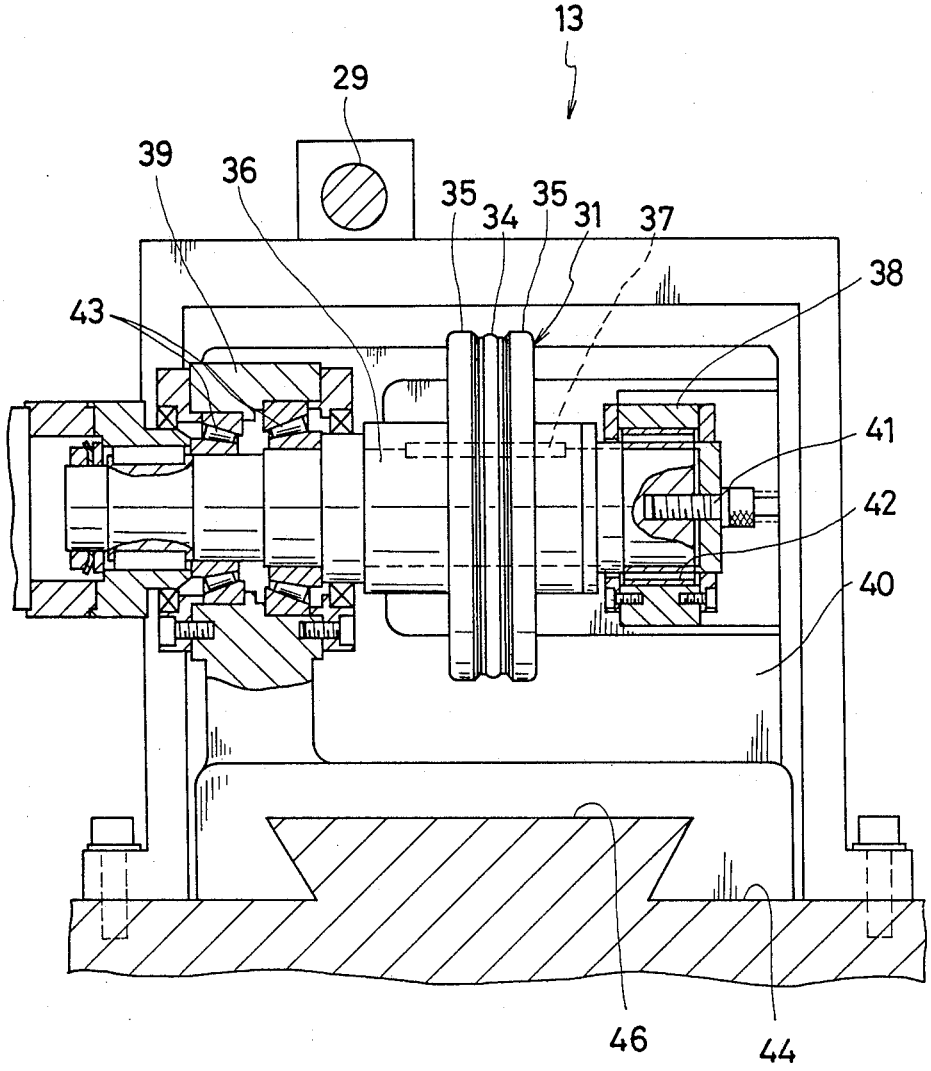
FIG. 6 is a side elevational view partially showing one side of a wheel forming roller.

In FIGS. 5 and 6 by operating forming member 13 a wheel body blank 11 fed from the feeding member or feeder 12, the blank wheel body 11 is formed or reshaped into a desired shape by the forming member 13, as to the inner circumferential surface, the outer circumferential surface and the body portion. Forming member 13 comprises three rotatable elements comprising a forming roller 31, a mandrel 32, and a support roller 33, with their respective axis being disposed in parallel. Forming roller 31 is provided at its intermediate peripheral surface area with a wheel body forming member 34 (which can be one of a number of different forming rollers 31 which are used for different sizes and shapes of the wheel body being formed) so that wheel body 11 is formed into a concave shape for an inner circumferential surface and into a concave shape for an outer circumferential surface.

On both circumferential surfaces of the wheel forming member 34 of roller 31, there are formed regulating surfaces 35 in a manner to face an opposite regulating surface, to be described hereinafter. Forming roller 31 is supported through a key 37 on a first shaft 36 while first shaft 36 is rotatably supported through bearings 42 and 43 on bilateral bearing members 38 and 39.

Bearing members 38 and 39 are formed in front of a slide block 40, with bearing member 38 external of first shaft 36 being detachably mounted, for example, by a bolt 41 so as to be removable when forming roller 31 is being changed.

The other bearing member 39 is formed integrally with slide block 40 which is housed in the inside of a box shaped cover 45 rigidly fixed upon an apparatus station 44. A guide 46 is formed with dovedail construction to enable slidable motion of the slide block 40.

Rearwardly of slide block 40 there is connected a piston 48 of a forming cylinder 47 mounted on apparatus station 44 to enable slide block 40 to be slidably moved.

Figure 7:
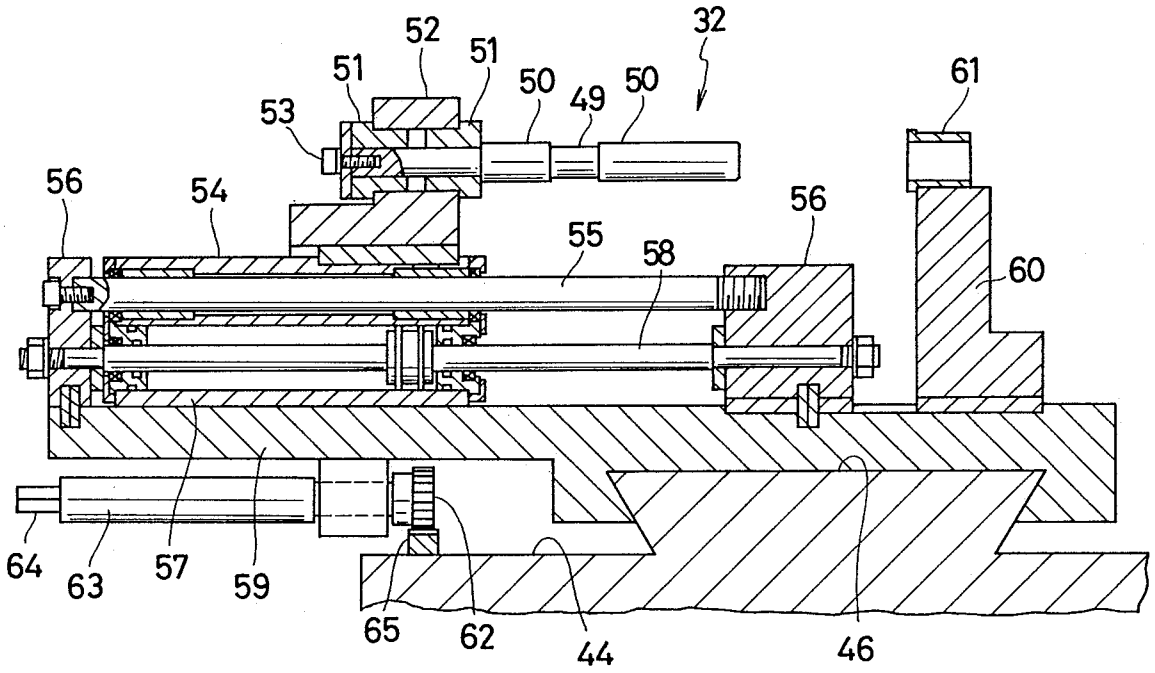
FIG. 7 is a vertical crossed side elevational view of a mandrel.

In FIG. 7 mandrel 32 has an intermediate circumferential surface formed into a wheel body forming member 49 of reduced diameter to form the inner circumferential surface of the wheel body 11, and of the same or larger diameter than surface 50 when the outer circumferential surface is being formed by forming roller surface 34. The mandrel forming surface may be of any desired shape and dimension depending on the shape and dimension of the wheel body desired to be formed.

On both peripheral surface areas of the wheel body forming member 49 of mandrel 32 there are formed regulating surfaces 50,50 which are opposite to regulating surfaces 35,35, respectively, of forming roller 31.

The extremities of mandrel 32 are rotatably supported through bearing member 51 on a supporting member 52 in a manner that mandrel 32 can be changed for a new one by removing a bolt 53 provided at the rear thereof. The supporting member 52 is fixed on the upper surface area of a slide body 54 which is supported in forward and rearward slidable relation by a pair of parallel guide rods 55,55 mounted between fixture members 56,56. Below slide body 54 there is formed a mandrel cylinder 57 integrally therewith, and a piston 58 inserted into mandrel cylinder 57 with both ends of piston 58 mounted on fixture members 56,56 so that when driven into rotation, cylinder 57 is made to slide forward and rearward in direction, to move mandrel 32. In the rear extremity of station 59, where fixture members 56,56 are rigidly fixed, there is a fixed support member 60 on which a receiving member 61 is mounted so that when mandrel 32 is moved to a position of forming wheel body 11 , mandrel 32 has its foremonst end moved. Mandrel 32 is disposed in an adjustable position with respect to support roller 33 which will be discussed further hereinafter.

Below station 59 there is pivotally supported a pinion 62 whose rotary shaft 63 is protruded forward of pinion 62 so as to be a handle mounting portion 64 to which a handle (not shown) is mounted operably.

To apparatus station 44 opposite pinion 62 there is rigidly mounted a rack 65 intermeshingly engageable with pinion 62 so that with the rotation of pinion 62 mandrel 32 is positioned adjustably (i.e. in direction into and out of the drawing sheet) through station 59 with respect to support roller 33. In FIG. 5, there is shown support roller 33 which is composed of a pair of rollers 66,66 disposed at regular spaced intervals so that mandrel 32 is supported by contacting the regulating surfaces 50 with roller 66.

It is preferred that roller 66 be in outer dimensions, approximately equal to or slightly larger than, the regulating surfaces 35,35. A second shaft 67 that rotably supports rollers 66,66 is supported on bilateral bearing members 68,69, similar to the arrangement of forming roller 31, through a key (not shown) and also through a suitable bearing.

Bearing members 68, 69 are formed in front of a fixture block 70 rigidly fixed on apparatus station 44, wherein bearing member 68, disposed externally of second shaft 67, is held by fixing bolt 71. With respect to support roller 33, a suitable roller 33 may be selected from a variety of types depending on the wheel body desired to be formed. Bearing member 69 on the other side, is formed integrally with fixture block 70. Forming member 13 is positionally adjusted so that it can move in the forward and rearward directions while in a position contactable with support roller 33. When mandrel 32 is forced under pressure by forming member 31, the related surfaces 50,50 are brought into contact with rollers 66,66 and roller 35 is moved from its oriented position depending on the degree of pressure exerted by forming member 31. Thus normally, mandrel 32 is moved back from a position whereat wheel body 11 is to be formed. The forming roller 31 ahd support roller 33 are located opposite each other and separated apart a distance for receiving wheel body 11 that is fed from feeding member 12. Once wheel body 11 is fed from feeding member 12 which is located above the wheel forming member 13, mandrel 32 advances toward a position whereat the step of forming the wheel 11 is performed, which mandrel 32 then is moved into the center of wheel body 11 just fed. The wheel body 11 is in a position for working the wheel body forming member 49 on the inner circumferential surface thereby to form the inner circumferential surface of desired dimensions. Then, forming roller 31 and support roller 33 are driven into rotation in a desired direction by driving member 14 to be described hereinafter.

Description of the Driving Member

Figure 8:
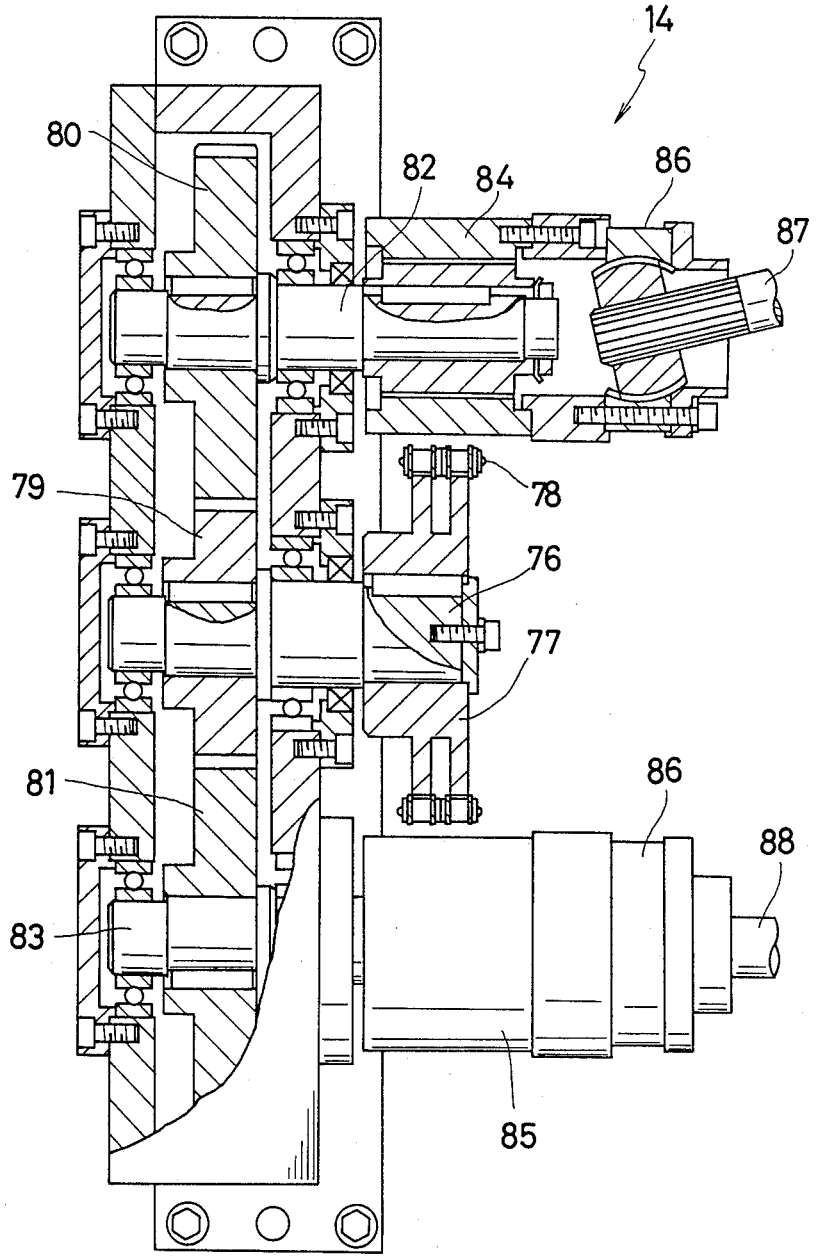
FIG. 8 is a top plan view partially showing a gear box.
Figure 9:
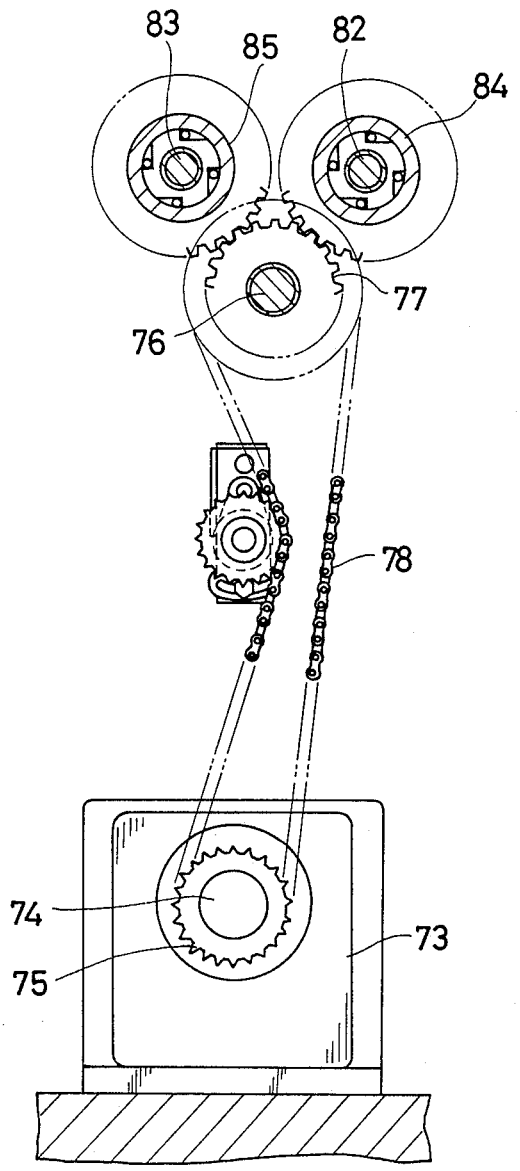
FIG. 9 is a front elevational view schematically showing a drive means.

In FIGS. 2, 8 and 9, there are depicted driving member 14 comprising a gear box 72, an electric motor 73 wherein two groove chains 78 are stretched between a sprocket wheel 75 rigidly fixed to an output shaft 74 of electric motor 73 and a sprocket wheel 77 rigidly fixed to an input shaft 76 of gear box 72 thereby enabling a driving free to be transmitted to gear box 72.

Within gear box 72 there are housed a gear 79 rigidly fixed to input shaft 76, first gear 80 and a second gear 81 both gears 80,81 being intermeshingly engageable and disengageable with respect to each other and located on both sides of gear 79. First gear 80 and second gear 81 have the same number of teeth, and the first output shaft 82 and second output shaft 83 supporting gears 80,81, respectively, are made to move at the same speed. Shafts 82,83 protrude out from gear box 72. To the outermost end of output shaft 82,83 there are connected one way clutches 84,85, and each end of coupling means 87,88 are flexibly connected to one another by engagement of a spline (not shown) while the other ends thereof are connected through free ball coupling means 86,86 to first shaft 36 and second shaft 67, to thereby permit driving force to be transmitted to gear box 72. The driving member 14 drives the first shaft 36 and second shaft 67, respectively, at the same speed by electric motor 73 which rotates in a predetermined direction.

Wheel body 11 is received on wheel forming member 49 of mandrel 32 so that forming roller 31 and support roller 33 are rotated along with rotation of first shaft 36 and second shaft 67. The forming operation for forming wheel body 11 starts by the forming cylinder 47 moving the forming roller 31 forwardly (left in FIG. 5).

Figure 10:
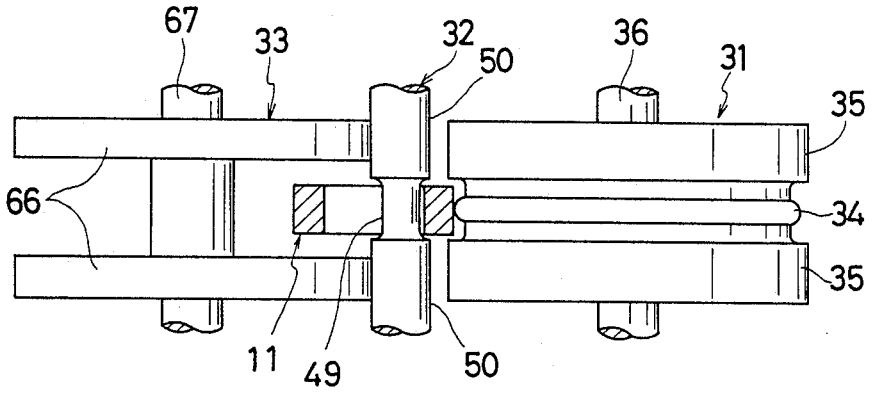
FIG. 10 is a top plan view partially showing how an inner circumferential surface is formed.

As shown in FIG. 10, once forming member 34 of forming roller 31 presses the circumferential surface of wheel body 11, mandrel 32 is moved slightly back by the load placed thereon so that the regulating surfaces 50,50 are brought into contact with rollers 66,66 of the support roller 33, thereby causing mandrel 32 to move.

Figure 11:
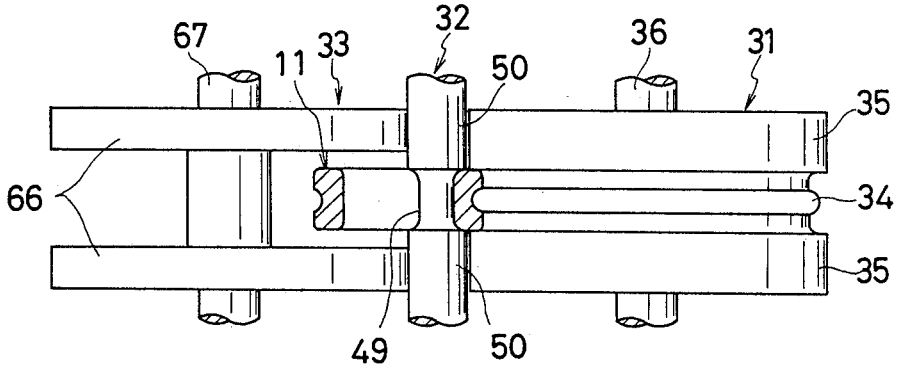
FIG. 11 is a top plan view partially showing how an inner circumferential surface and body portion are formed.

At the initial stage, the rotating outer diameter of the wheel body 11 is greater than the regulating surface 50 (i.e. outer diameter of the end position 50) of the mandrel 32. Thus, the outer circumference speed of the wheel body 11 is higher than the circumferential speed of the forming roller 31. The two speeds are made to be the same in the following manner. The driving means of forming roller 31 is provided intermediately with one way clutch 84 which clutch 84 is set free and the forming roller 31 is made to rotate at the same speed as the wheel body 11. Thus, by the leftward(in FIG. 2) pressure exerted by cylinder-piston arrangement 47,48 (of FIG. 5) and through the forming roller 31, wheel body 11 is rollingly pressed so that when the width of wheel body 11 reaches a predetermined rough formed dimension, the rolling pressure comes to an end (see. FIG. 11). By this rolling pressure, wheel body 11 also has its outer circumferential surface formed with a concave channel surface(by action of both forming surface 34) to thereby form wheel body 11 as desired. The body 11 has a plain inner circumferential surface, without a channel and with the entire direction being concave, as shown in FIG. 11. The width of body 11 is formed by the pressure of roller 31 having smaller diameter area (see 34 in FIG. 12) at the center part thereof between the larger diameter ends (see 35 in FIG. 12) against body 11.

The inner diameter of inner circumferential surface of wheel body 11 is roughly formed to a diameter slightly smaller than the ultimate desired diameter so as to be subjected to a final finishing operation which will be hereinafter described.

After a predetermined rolling pressure is exerted on wheel body 11, forming roller 31 and mandrel 32 are moved back to the original position Then, wheel body 11 on mandrel 32 is removed from mandrel 32, by being forcibly dropped.

In the lower portion of forming member 13 there is provided a second chute 90 extending to finishing member 15 as shown in FIG. 1 so that a rough formed wheel 11 is fed through second chute 90 to finishing member 15.

FIG. 11 shows the forming of outer circumferential surface of wheel body 11 wherein a concave groove forming part 34 on roller 31 engraves a channel on the outer circumferential surface of wheel body 11.

Figure 12:
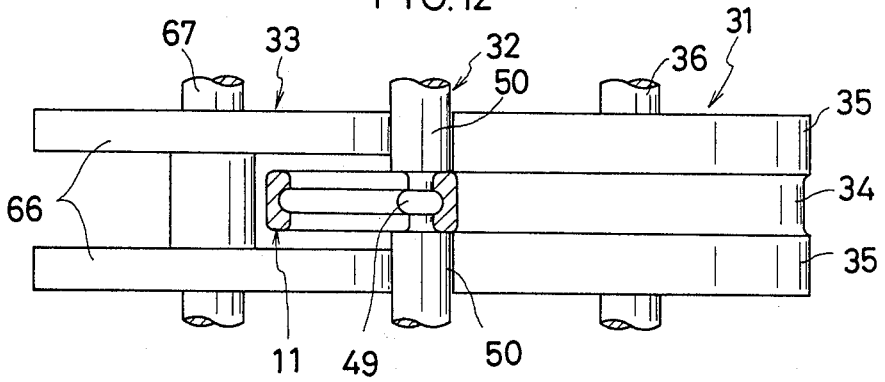
FIG. 12 is a top plan view partially showing how an outer circumferential and body portion are formed.
Figure 13:
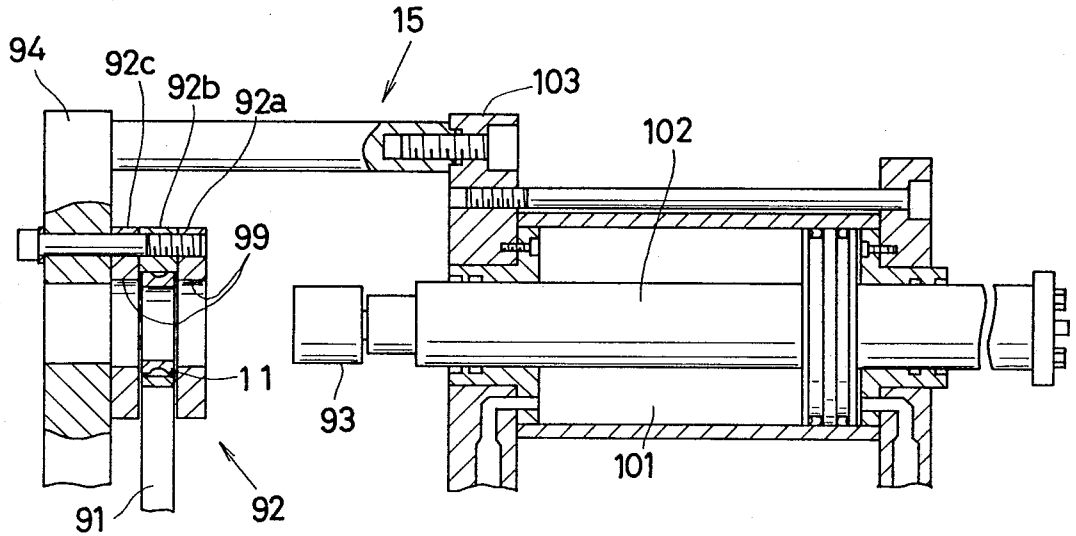
FIG. 13 is a partially cut away side elevational view showing a final for the inner circumferential surface.
Figure 14:
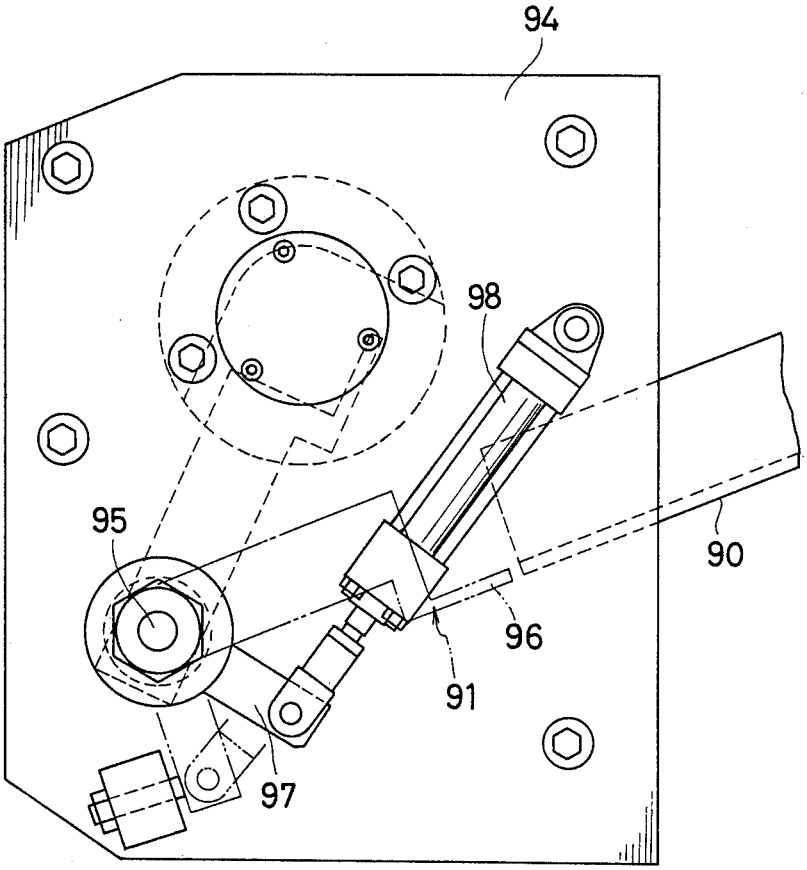
FIG. 14 is a front elevational view thereof.

FIG. 12 shows the forming of the inner circumferential surface of by body , wherein a convex ball like forming part 49 is on mandrel 32. The convex ball like part 49 causes a channel to be formed in the in circumferential surface of body 11.

The body portion of wheel body 11 is formed by the inner walls of the wheel portion 50,50 of mandrel 32 and the wheel portion 35,35 of finishing roller 31, such as depicted in FIGS. 11, and 12.

Description of Finishing Member

(Finishing of the Inner Circumferential Surface of Wheel Body)

FIGS. 1,2,13 and 14 show finishing member 15 which is used to finish the inner circumferential surface, the outer circumferential surface and the body portion of the rough formed wheel body 11. The finishing member finishes the body as a finished unit as desired depending on the wheel body unit being formed. The finishing member 15 for the inner circumferential surface is provided with a feeding rod 91 which receives wheel body 11 fed from second chute 90 and transfers the body 11 to the position where rough forme wheel body 11 is to be finished, with a receiving station 92 for holding body 11 in position for finishing, and with a punch 93 which finishes the wheel body 11 by a punching operation. The feeding rod 91 has its extremity fixed to a rotary shaft 95 pivotally supported at a fixture wall 94 with its other free extremity being formed into a substantially L shaped receiving member 96 for receiving the rough formed body 11.

The feeding rod 91 moves from a receiving position below the second chute 90 whereat the rough formed body is dropped from second chute 90, to a finishing position whereat rod 91 places the body at the receiving station 92.

Rotary shaft 95 has its outer extremity protruded externally of fixture wall 94. The lever 97 is fixed to the shaft extremity and a cylinder-piston arrangement 98 is pivotally supported to the fixture wall 94 so that feeding rod 91 is rotated by motion of the cylinder-piston arrangement 98. The receiving station 92 comprises three stations 92*a*, 92*b*,92*c*. Intermediate of the three station there are bored through holes 99. The intermediate station 92*b* is notched to receive body 11 carried by receiving element 96 of feeding rod 91. In this case, since wheel body 11 to be finished,is to be finished on the inner circumferential surface, the through holes 99 bored on the front end and rear receiving stations 92*a* and 92*c* are substantially smaller in diameter than the outer circumferential surface but larger in diameter than the inner circumferential surface so that when punch 93 is removed, front and rear receiving stations 92*a* and 92*c* receive body 11 along the edge of the through holes 99. The wheel body is placed between stations 92*a* and 92*c* at station 92*b*.

The punch 93 has an outer diameter of the foremost end thereof formed to be smaller than the inner diameter of wheel body 11 roughly formed in forming member 13 and the outer diameter of the rear most side if punch 9 is formed equal to the finished inner circumferential surface of body 11. Thus, punch 93 is inserted into the center hole of body 11 to finish the inner circumferential surface of body 11.

The punch 93 is detachably mounted to the foremost end of a piston 102 of a finishing cylinder so as to be readily changeable depending on the desired dimensions of the wheel body 11. The finishing cylinder 101 is mounted on a fixture wall 103 and is disposed in opposition to fixture wall 94 at a fixed spaced apart interval as depicted.

The inner circumferential surface finishing member 15 is adapted to feed the formed body 11 to the intermediate receiving station 92*b* by operation of feeding rod 91. Then, punch 93 is advanced forward and inserted into the center hole of body 11 and the work surfaces of punch 93 comes into contact with and finishes to the desired diameter the inner circumferential surface of body 11. Then, punch 93 is moved back to its original position.

After wheel body 11 is finished, feeding rod 91 by operation of piston arrangement 98 and lever 97, comes down to a discharge position which is lower than the position of second chute 90, to permit the finished wheel body 11 to drop from the position whereat the body 11 is mounted, thereby to complete the finishing process for the inner circumferential surface.

(Finishing the Outer Circumferential Surface of the Wheel Body.)

Figure 15:
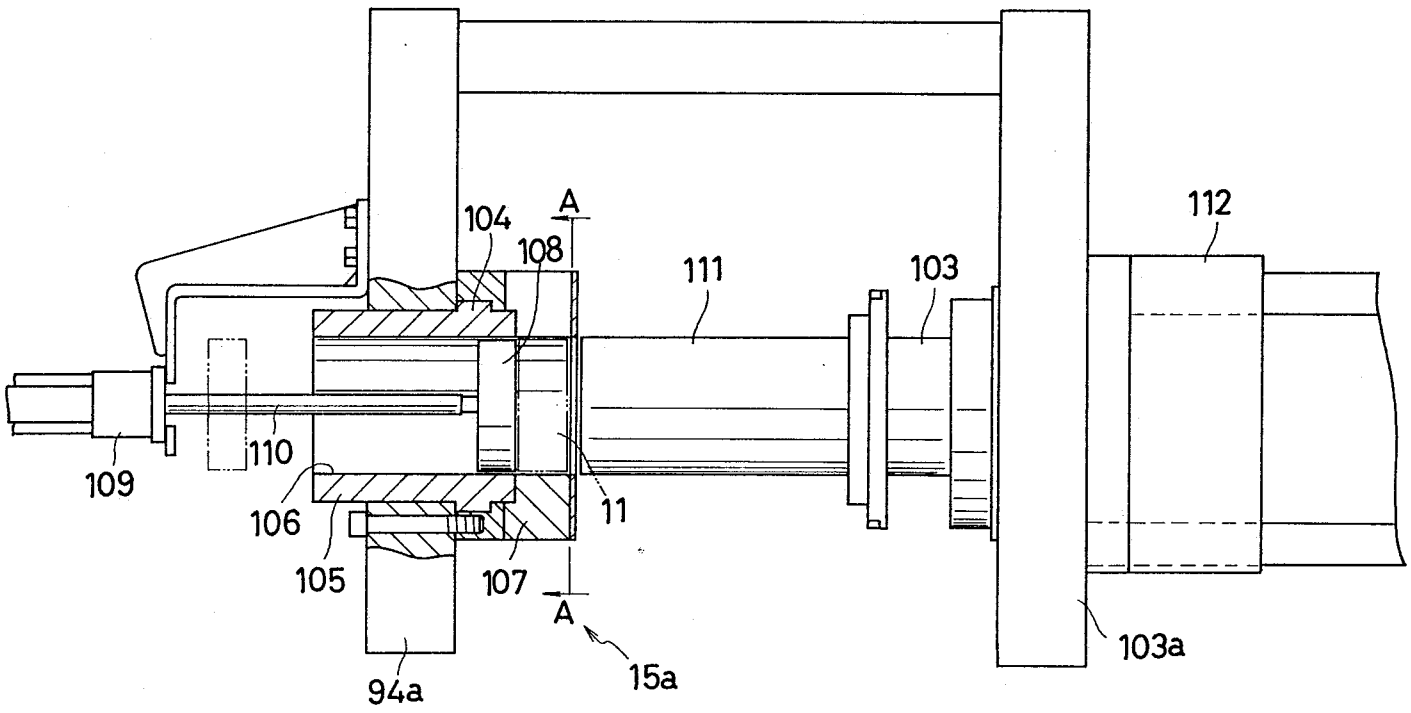
FIG. 15 is a partially cut away elevational view showing the final finishing member for the outer circumferential surface.
Figure 16:
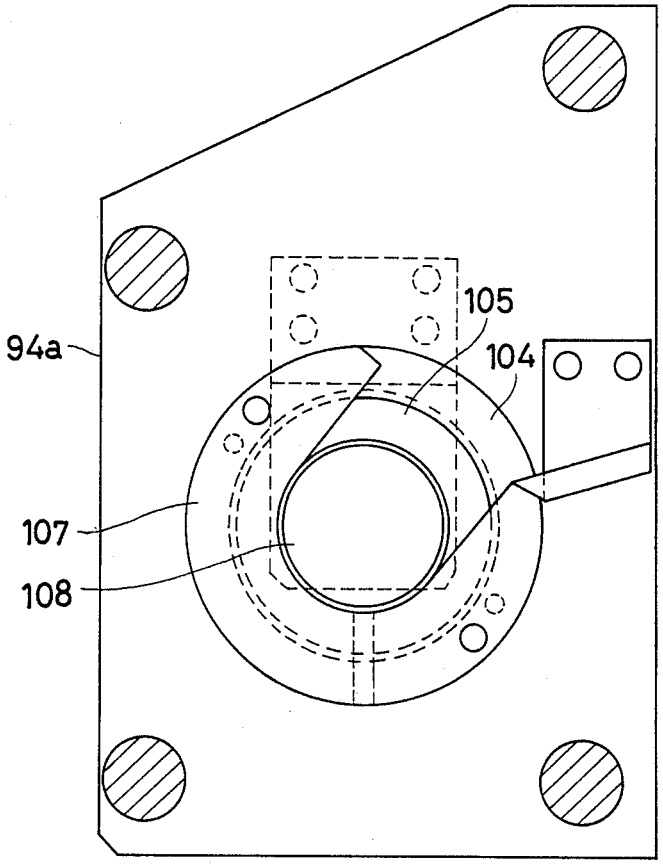
FIG. 16 is a perspective view taken along line A—A of FIG. 15.

FIGS. 15 and 16 show a finishing member 15*a* for finishing the outer circumferentially surface of .the wheel body 11, which member 15*a* is in the form of a changeable unit which is substituted in place of finishing member 15.

With respect to finishing member 15*a*, a die 105 is mounted on the fixture wall 94*a* by a mounting member 104. Die 105 has its inlet formed to be a little larger in inner diameter than the outer diameter of the wheel body 11, and with its outlet formed to be of a finished size with an inner diameter 106. Thus, by inserting a wheel body having a rough formed outer circumferential surface into the die 105 a desired size of finished outer circumferential surface is obtained.

To the inlet of die 105 there is fixed a substantially U shaped holder 107 with its opening facing second chute 90. Holder 107 is engaged with the inlet of die 105. In the inside of die 105 there is provided a receiving plate 108 at the backside of which there is connected a piston rod 110 of a cylinder 109. The cylinder 109 may be of the type which operates by rotating to push out or bring in the rod 110. The receiving plate 108 in the position of the inlet of the die 105 supports wheel body 11 having the outer circumferential surface to be finished so as to not permit the wheel body to drop. When wheel body 11 , having its outer circumferential surface to be finished, is inserted into die 105, die 105 moves back depending on the insertion operation of body 11 thereby to help the outer circumferential surface to be finished. Externally of holder 107 there is disposed a punch 111 which is disposed in opposite relation thereto. Punch 111 is connected to a piston 103 disposed in a finishing cylinder 112 which is connected also to a fixture wall 103*a*.

When wheel body 11, having its outer circumferential surface still to be finished, is fed to holder 107, holder 107 prevents wheel body 11 from dropping between receiving plate 108 and punch 111. Cylinder 109 and piston 110 stop operation with receiving plate 108 being in position so that punch 111 is permitted to advance forward to insert the rough formed wheel body 11 into die 105. Thus, wheel body 11 having the unfinished outer circumferential surface is finished by the body 11 being pushed by punch 111 through die 105 and being discharged out of the outlet of the die 105. The diameter of the die 105 is reduced from right to left and the outer circumferential surface of the body 11 is reduced to the finished size at the outlet of die 105. The punch 111 pushes against pressure exerted by cylinder 109 through piston 110.

At the end of the die punching, the cylinder 109 and rod 110 are operated and the receiving plate 108 is moved to the outlet of die 105, thus completing the finishing of the outer circumferential surface of the wheel body 11.

(Finishing of the Body Portion of Wheel Body)

Figure 17:
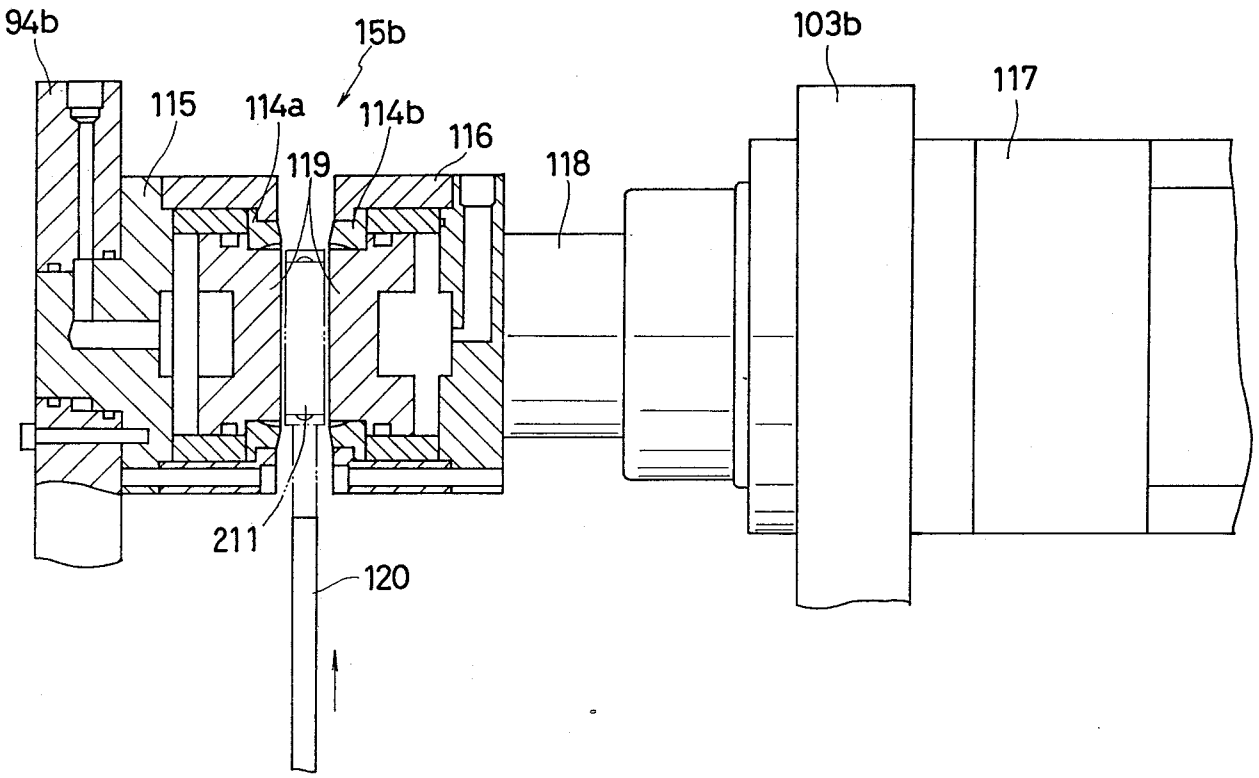
FIG. 17 a side elevational view showing a finishing member for the body portion of the wheel body.

The body portion finishing member **16*b*, illustrated in FIG. 17, is also formed as a unit, which is interchangeable with finishing members 15 and 15*a*. Finishing member 15*b* comprises a pair of dies 114*a* and 114*b* divided into two as depicted. Die 114*a* is rigidly fixed to the fixture wall 94*b* through a mounting member 115. Die 114*b* is mounted to the foremost end of a piston 118 of a finishing member 117 through a mounting member 116. Centrally of dies 114*a* and 114*b* there are insertibly supported two holders 119,119 operable by hydraulic pressure, for holding wheel body 11 in position. In the lower portion of holders 119, 119, opposite to one another there is provided a feeding rod 120 by means of which the rough formed wheel body 11, which is fed by vertically movable forming member 13 (see FIGS. 1,2), is transferred between the dies 114*a* and 114*b*. Forming member 13** is driven by a suitable crank mechanism.

In operation, feeding rod 120 receives the rough formed body 11 which is fed through chute 90 from forming member 13. The body 11 is fed to the holders 119 and 211. Holders 211 and 119 are operated by hydraulic pressure to hold body 11 in position therebetween. Then, feeding rod 120 moves back to its position for receiving body 11.

Then, finishing cylinder 117 and rod 118 are operated to move die **114*b* to die 114*a* so as to press the body portion of wheel body 11 between dies 114*a* and 114*b* and thereby release the hydraulic pressure of holders 119 and 119, and enhance the hydraulic pressure on dies 114*a* and 114*b*. Consequently, the body portion of wheel body 11 is finished to a desired dimension and shape. Then, dies 114*a* and 114*b* are released to permit body 11 to drop. In this case, holders 119 and 119** are moved back to their original positions by hydraulic pressure so that operation of finishing the body portion of the wheel body is completed.

According to the invention, the wheel body 11 is pressed between wheel body forming members 49 and 34, respectively to rollingly press wheel body 11 into a rough formed shape with the working surfaces of both the forming roller 31 and wheel body 11 are brought into contact to produce the least contacting surface area. As a result only a small amount of pressure is sufficient to complete pressing of the wheel body. Thus, the invention enable use of an apparatus which uses only a small amount of pressure, which apparatus can thus be of a small size.

Furthermore, the invention provides that when the circumferential of the wheel body is higher than the circumferential speed of the forming roller 31, then one way clutch 84 is set free so that the circumferential speeds of both are made to equal each other. On the other hand, when the circumferential speed of the forming roller 31 is higher than the circumferential speed of the wheel body, then one way clutch 85 is set free so that the two circumferential speeds are made equal to each other. Thus, advantageously, the invention eliminates the defects which are otherwise caused by unequal circumferential speeds of the wheel body and forming roller. Accordingly, wheel bodies formed by the invention are of high quality and are not subject to destruction by vibrations, deformity and deviations.

What is claimed is:

1. A bearing wheel body forming apparatus comprising a rotatable mandrel of cylindrical shape comprising a pair of contacting surfaces of a first diameter and a forming surface of a second diameter, said second diameter being smaller than said first diameter;

wherein the apparatus is used to work on a cylindrical shaped wheel body to be formed, said body comprising a cylindrical body, an outer circumferential surface of a third diameter, an inner circuferential surface of a fourth diameter, and a center hole, said fourth diameter being greater than said first diameter, said wheel body being disposed to fit about the forming surface of said mandrel with part of said inner surface of the wheel body being against said forming surface during forming operation;

a rotatable support roller comprising a pair of contact surfaces of a fifth diameter, wherein said fifth diameter divided by two is greater than the third diameter divided by two, and an inner cylinder surface therebetween of an axial length greater than the width of said wheel body and of a diameter smaller than said fifth diameter;

a rotatable forming roller comprising a pair of contact surfaces of a sixth diameter and a forming surface disposed therebetween of a seventh diameter;

wherein when the contacting surface of the mandrel is against the contacting surface of the forming roller, the space between the forming surface of the mandrel and the forming surface of the forming roller is the desired dimension of the wheel body to be formed;

first pressing means for pushing said pair of contacting surfaces of said support roller against said pair of contact surfaces of said mandrel;

second pressing means for pushing said pair of contact surfaces of said forming roller toward said pair of contacting surfaces of said mandrel;

wherein said wheel body is disposed on the mandrel between the pair of contact surfaces of the support roller, and with the inner circumferential surface disposed toward the forming surface of the mandrel and the outer circumferential surface contacting the forming surface of the forming roller; and drive means for rotating the support roller and the forming roller at the same speed, comprising motor means, a pair of one-way clutches driven by said motor means, and connecting means disposed between said pair of one-way clutches and each of said respective support roller and said forming roller, wherein said connecting means comprises a pair of free coupling means, whereby said motor means continuously rotates said support roller and said forming roller concurrently with the application of pressure by said first and second pressing means, and said connecting means causes said forming roller to become free of said rotating by said motor means when the speed of the outer circumferential surface of the wheel body is greater than the circumferential speed of the pair of contact surfaces of the mandrel thereby to provide substantially the same circumferential speed at the forming surface of the forming roller and the outer circumference surface of the wheel body being formed.

2. The apparatus of claim 1, wherein said forming surface of said mandrel comprises a ball like forming part of greater diameter than said second diameter for forming a channel in the inner circumferential surface of the wheel body.

3. The apparatus of claim 1, wherein said forming surface of said forming roller comprises a ball like forming part of a diameter greater than said seventh diameter for forming a channel in the outer circumferential surface of the wheel body.

4. The apparatus of claim 1, further comprising a finishing mechanism for forming said wheel body into a predetermined shape by mutual pressure of both an unfinished rollingly pressed wheel body and a frame member.

* * * * *